US006062941A

United States Patent [19]

Cook

[11] Patent Number: 6,062,941

[45] Date of Patent: May 16, 2000

[54] HAND HELD DOLL HAVING WHIP-CRACKING MOTION

[75] Inventor: Robynn M. Cook, Aliso Viejo, Calif.

[73] Assignee: Mattel, Inc., El Segundo

[21] Appl. No.: 09/244,610

[22] Filed: Feb. 4, 1999

[51] Int. Cl.[7] ..... A63H 3/20

[52] U.S. Cl. ..... 446/352; 446/330; 446/336

[58] Field of Search ..... 446/330, 336, 446/352, 354, 390

[56] References Cited

U.S. PATENT DOCUMENTS

| | | | |
|---|---|---|---|
| 3,724,125 | 4/1973 | Goldfarb et al. | 446/330 |
| 3,902,272 | 9/1975 | Molenaar | 446/415 |
| 3,955,311 | 5/1976 | Lyons et al. | 446/335 |
| 4,605,382 | 8/1986 | Cook et al. | 446/336 X |
| 4,608,026 | 8/1986 | Newton et al. | 446/330 |
| 4,655,725 | 4/1987 | Torres | 446/246 |
| 4,666,419 | 5/1987 | Droller et al. | 446/330 |
| 4,738,649 | 4/1988 | Delli Bovi et al. | 446/336 |
| 5,011,448 | 4/1991 | Asano | 446/293 |
| 5,046,987 | 9/1991 | Djordjevic | 446/336 |
| 5,087,219 | 2/1992 | Price | 446/336 |
| 5,290,185 | 3/1994 | Murakami | 446/334 |
| 5,376,039 | 12/1994 | Balgin | 446/307 |
| 5,378,188 | 1/1995 | Clark | 446/330 |

*Primary Examiner*—John A. Ricci
*Attorney, Agent, or Firm*—Roy A. Ekstrand

[57] ABSTRACT

A hand held doll includes a body supported by a pair of legs and having a pair of arms and a head. One of the arms is pivotally supported upon the torso portion of the body and holds a simulated whip formed of a flexible cord and end weight. The drive mechanism within the body interior includes a movable panel which is pressed inwardly when the body is squeezed and a return spring which restores the panel position when the torso is released. A gear drive mechanism operatively couples the pivotally moving panel and an arm gear such that panel movement during successive squeezes and releases of the doll torso causes the whip holding arm to be rapidly raised and lowered to "crack" the whip. A flexible reed within the doll interior is caused to make clicking sounds as the panels moves in and out.

4 Claims, 1 Drawing Sheet

HAND HELD DOLL HAVING WHIP-CRACKING MOTION

FIELD OF THE INVENTION

This invention relates generally to toys and doll figures and particularly to those having articulated limbs and appendages capable of a predetermined motion.

BACKGROUND OF THE INVENTION

Dolls and toy figures have enjoyed great popularity for an extended period of time and have been enjoyed by children of a very broad age range. The long term and extended range of popularity for such dolls and toy figures has prompted practitioners in the art to create a virtually endless variety of dolls and toy figures. Many of the dolls and toy figures provided by practitioners in the art tend to mimic various normal human actions. Thus, for example, dolls and toy figures have been provided which are able to walk, crawl, swim, skate, fight and so forth.

In addition to various activities performed by dolls and toy figures, the advent of relatively low cost, miniature microprocessors and speech chips by practitioners in the electronic arts have made possible additional sound features in dolls and toy figures such as talking, laughing, singing and crying to name a few. As the cost of such miniature speech circuit apparatus continued to decrease, it became more and more common for practitioners to include a sound feature.

In addition to the variation of activities performed and accompanying sound or speech, such dolls and toy figures have varied greatly in their appearance. Thus, dolls and toy figures have been provided which are very realistic in appearance while others have been provided which are extremely fanciful or exaggerated. Many dolls and toy figures assume appearances characteristic of monsters or other creatures while still others have been given cartoon character like appearances.

As dolls and toy figures continue to develop, the mechanism used to power the activity aspects of the dolls and toy figures evolved from simple manual manipulation to motor-powered apparatus. Motor power devices have included spring-driven wind-up type apparatus as well as battery-powered electric motor drive mechanisms. As a result of all this development, dolls and toy figures have been increasingly more sophisticated and complex. For example, U.S. Pat. No. 5,290,185 issued to Murakami sets forth a HOOK THROWING BOXING REMOTE CONTROL TOY ROBOT having arm appendages capable of realistic boxing movements. The robot includes a plurality of driver devices each having an electric motor. The robot arms are driven by the driver devices and are remotely controlled. Additional drivers are operative to further articulate and move the robot in a boxing-type action.

U.S. Pat. No. 5,376,039 issued to Balgin sets forth a ROPE-SKIPPING TOY having a torso supporting a plurality of drive cams and a motor power source. A pair of arm appendages are secured to a transversely extending driven shaft which in turn supports an elongated jumprope. As the battery powers the plurality of cams in the drive mechanism, the arms and the elongated rod undergo rotation producing a corresponding rotation of the jumprope. The doll is caused to rise sufficiently to allow the bottom portion of the jumprope to pass beneath the doll by a spring-loaded weight mechanism.

U.S. Pat. No. 3,955,311 issued to Lyons, et al. sets forth a MECHANISM FOR MOVING AN UPPER APPENDAGE OF A TOY FIGURE having a torso supporting a depressible button and further supporting at least one pivotal arm appendage. A movement mechanism supported within the torso operatively couples the push button to the movable arm to facilitate a sword/type movement.

U.S. Pat. No. 4,655,725 issued to Torres sets forth an ANIMATED FIGURE TOY having an upper torso with an arm member pivotally coupled to the shoulder portion thereof. The arm member is hollow and includes a rotatable assembly at the shoulder area operative in conjunction with a wrist portion. The arm and wrist cooperate to simulate the use of a hand held weapon.

U.S. Pat. No. 3,724,125 issued to Goldfarb, et al. sets forth a PUSH BUTTON DOLL having a body supporting a plurality of movable limbs. A drawstring mechanism is wound between the movable limbs and a centered disk such that pressing the center disk causes tension on the drawstring to move the limbs.

U.S. Pat. No. 4,608,026 issued to Newton, et al. sets forth a FIGURE WHEREIN MANIPULATION OF ONE LIMB CAUSES MOTION OF ANOTHER having a pivotally supported leg coupled to a doll torso which in turn supports a movable arm. An operative mechanism is coupled between the pivotal leg and the arm such that inward movement produced by squeezing the figure's legs together causes the arm to undergo a predetermined movement.

U.S. Pat. No. 5,046,987 issued to Djordjevic sets forth TOY BOXER ARMS for a doll having a torso for supporting a pair of arms in a pivotal attachment. A pair of rotational drive mechanisms articulate the figure's arms in a punching action similar to a boxer.

U.S. Pat. No. 5,087,219 issued to Price sets forth an ACTION CHARACTER FIGURE having an upper torso coupled to a telescoping pair of legs. A pair of arms are further coupled to the torso and a spring is provided for urging the legs downwardly from the upper torso. A pivotal arm action is coupled to the biasing spring and when rotated, causes the retracted legs to be thrust downwardly whereby the figure jumps.

U.S. Pat. No. 4,738,649 issued to Dellibovi, et al. sets forth a FIGURE TOY WITH PUNCHING ARM MECHANISM having a spring-powered rotatable arm which is capable of simulating a striking action. The arm utilizes a spring motor with a ratchet and clutch arrangement which permits full winding while protecting the mechanism against damage due to excessive rotation of the punching arm in either direction.

U.S. Pat. No. 5,011,448 issued to Asano sets forth a SPIRAL SPRING-DRIVEN DOLL TOY having a wind-up spring motor for moving appendages of a doll toy.

U.S. Pat. No. 3,902,272 issued to Molenaar sets forth a SOUND GENERATING DEVICE capable of producing a brief sharp snap or click sound. A housing supports a resilient flexure member or plate above an acoustic chamber. Finger pressure upon the mid-portion of the plate causes buckling of the plate between the ends to produce an audible snap or click.

While the foregoing described prior art devices have improved the art and in some instances enjoyed commercial success, there remains nonetheless a continuing need in the art for evermore improved, entertaining, and cost effective dolls and toy figures which provide a movement activity.

SUMMARY OF THE INVENTION

Accordingly, it is a general object of the present invention to provide an improved doll or toy figure. It is a more particular object of the present invention to provide an improved hand held doll or toy figure having a unique arm motion achieved in a relatively simple manner.

In accordance with the present invention, there is provided a hand held doll comprising: a body having a head, supporting legs and a torso; an arm pivotally supported at the torso and having a hand; a gear joined to the arm pivotal therewith; a simulated whip having a handle held by the hand, a flexible cord and an end weight; a housing supported within the body supporting the arm and the gear and having a panel pivotally supported by the housing and a gear segment engaging the gear; and a return spring coupled to the panel urging the panel outwardly, the panel pivoting inwardly when the doll is squeezed and pivoting outwardly by the spring when the squeeze is released thereby pivoting the gear segment and the gear to pivot the arm in a whip cracking movement.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
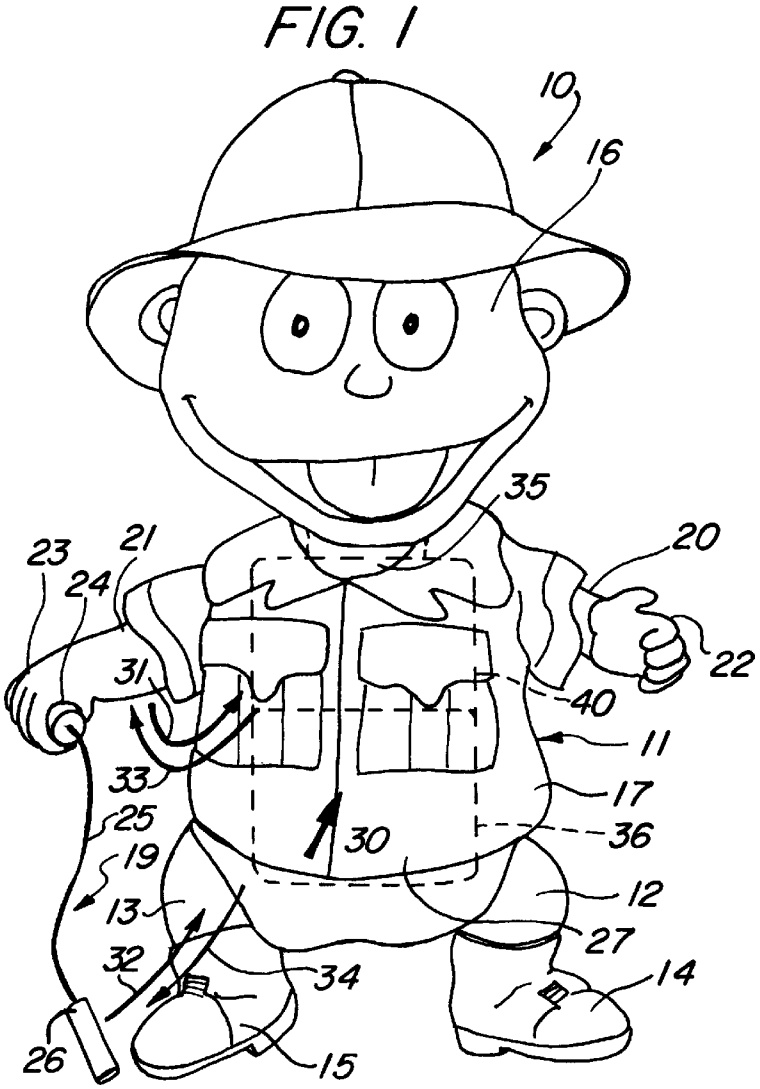
FIG. 1 sets forth a front perspective view of a hand held doll constructed in accordance with the present invention.

FIG. 1 sets forth a front perspective view of a hand held doll constructed in accordance with the present invention and generally referenced by numeral 10. It will be understood that while a fanciful human infant appearance is provided by doll 10, this appearance is merely exemplary of a variety of different appearances which may be utilized with doll 10 without departing from the spirit and scope of the present invention. Further, doll 10 will be understood to be representative of a variety of dolls and toy figures fabricated of a corresponding variety of materials all of which are collectively referred to herein as "dolls". Thus, doll 10 includes a body 11 having a torso 27 supported by a pair of legs 12 and 13. Legs 12 and 13 are further supported by a pair of feet 14 and 15 respectively. Body 11 further includes a pair of arms 20 and 21 having hands 22 and 23 respectively formed therein. Body 11 also includes an upwardly extending neck 35 supporting a head 16.

Body 11 is partially covered by an outer garment 17 which is preferably formed of a flexible fabric material or the like and which is formed to generally resemble clothing worn by a young child. In the preferred fabrication of the present invention, body 11 is formed of a soft plush type material or provide a squeezeable and huggable character for doll 10. In further accordance with the present invention, torso 27 defines an interior cavity 55 (seen in FIG. 2) within which a housing 40 is supported. By means set forth below in greater detail in conjunction with FIG. 2, housing 40 supports an arm rotating mechanism which is operatively coupled to arm 21. As is also described below in greater detail, housing 40 supports a movable panel 36 within torso 27 of body 11. The operative mechanism within housing 40 is set forth below in greater detail. Suffice it to note here that a drive mechanism within housing 40 is operatively coupled to arm 21 and responds to inward and outward movement of panel 36 within torso 27.

Doll 10 further includes a whip handle 24 received within hand 23 and supporting an elongated flexible cord 25. Cord 25 defines an outer end supporting an end weight 26.

In operation, the user initially squeezes torso 27 with sufficient force to pivot panel 36 inwardly in the direction indicated by arrow 30. The inward movement of panel 36 produces a pivotal movement of arm 21 forwardly and upwardly in the direction indicated by arrow 31. The movement of arm 21 in turn moves hand 23 and whip handle 24 in the same direction. As handle 24 is moved upwardly, cord 25 is drawn upwardly carrying weight 26. Thereafter, as the user releases panel 36, a return spring mechanism (seen in FIG. 2) returns panel 36 to its outward position. The drive apparatus within housing 40 described below responds to the return motion of panel 36 and pivots arm 21 downwardly and rearwardly in the direction indicated by arrow 33. Correspondingly, hand 23 and whip handle 24 undergo the same downward and rearward motion drawing cord 25 and weight 26 in a similar downward and rearward motion. The user soon learns that the optimum timing and movement of repeatedly squeezing torso 27 and releasing it causes motion of arm 21 which closely simulates a cracking of whip 19.

Figure 2:
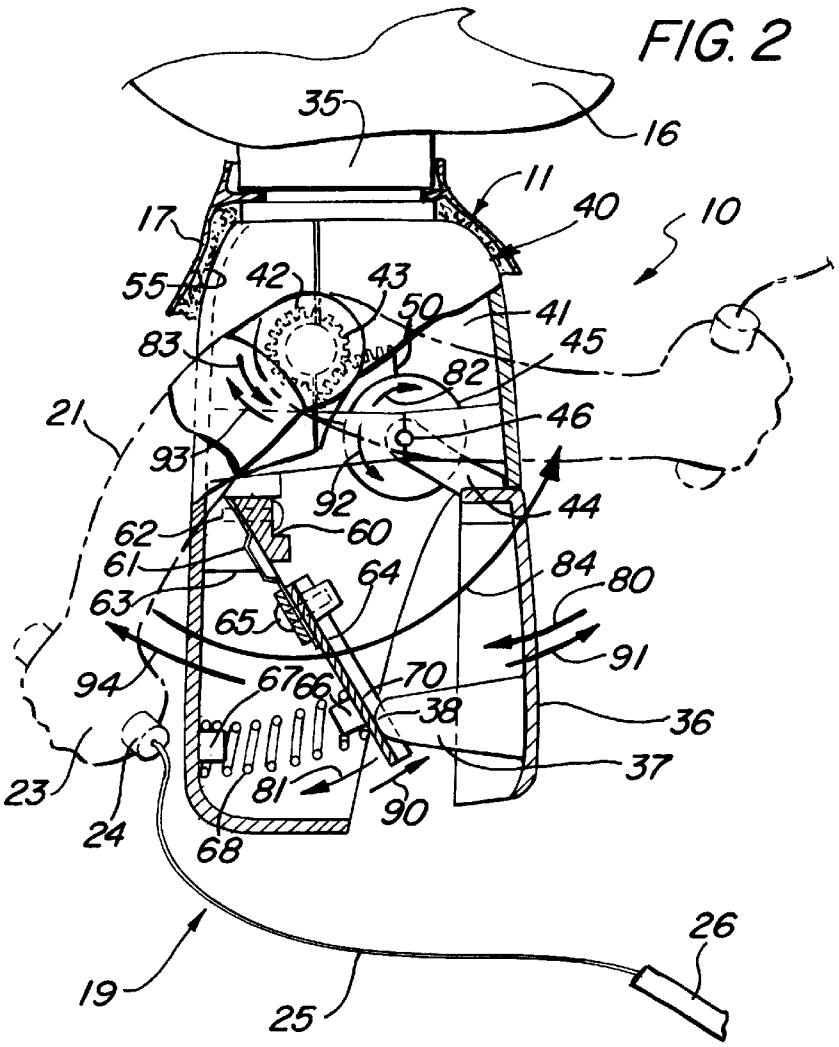
FIG. 2 sets forth a partial section side view of the operative mechanism of the present invention hand held doll.

In addition to the arm motion and whip-cracking action provided as the user squeezes and releases torso 27 on a repeated basis, a whip cracking sound effect is provided by a flexible reed (reed 61 shown in FIG. 2). Suffice it to note here that the sounding device of the present invention is preferably fabricated as a "clicker" of the type often utilized in simple hand held noisemakers which provide a click sound when the reed is bent and a click sound when the reed is allowed to straighten itself. Such devices are also often referred to as "cricket noisemakers".

Thus, as the child user becomes familiar with the action of the whip-cracking activity of doll 10, the user becomes correspondingly skilled at squeezing and releasing torso 27 to provide the action of whip 19.

FIG. 2 sets forth a partially sectioned side view of the operative mechanism of the present invention doll supported generally within housing 40. Thus, doll 10 includes a body 11 having an outer garment 17 and defining an interior cavity 55. As mentioned above, body 11 is preferably formed of a plush-type fabrication in which a quantity loose fill or packing material is supported within the interior of garment 17.

Housing 40 is preferably fabricated of a rigid molded plastic material or the like and is joined to head 16 by a neck 35. Housing 40 defines an interior cavity 41 and a movable panel 36. Moveable panel 36 is supported by an arm 44 which in turn is joined to a wheel 45. Wheel 45 in turn supports a gear segment 50. In the preferred fabrication of the present invention, arm 44, wheel 45 and gear segment 50 are joined together and rotatable about a shaft 46 supported within interior cavity 41 in accordance with conventional fabrication techniques (not shown). Panel 36 further includes an inwardly extending post 37 having an end 38 formed thereon.

An arm shaft 42 is rotatably supported upon housing 40 in accordance with conventional fabrication techniques. Arm shaft 42 is joined to arm 21 and supports a gear 43. Gear 43 and arm 21 are rotatable upon shaft 42. Furthermore, gear 43 engages gear segment 50.

As described above, arm 21 includes a hand 23 within which a whip handle 24 is supported. Whip handle 24 may be formed integrally with hand 23 and arm 21 if desired. Whip handle 24 supports a flexible cord 25 which in turn supports an end weight 26. The combination of whip handle 24, cord 25 and weight 25 form a whip 19.

A flexible clicker type reed 61 formed of a suitable spring steel material or the like is secured to the interior of housing 40 by a clamp 60 using a conventional fastener 62. A second portion of flexible reed 61 is secured to a cam plate 64 by a conventional fastener 65. Plate 64 defines a surface 70 against which end 38 of post 37 rests. Plate 64 further defines a post 66 while the interior of housing 40 supports a similar post 67. A spring 68 is received upon posts 66 and 67 and is captivated therebetween. Spring 68 produces a spring force urging plate 64 toward the position shown in FIG. 2. The outward force provided by spring 68 against plate 64 also provides a positioning for panel 36.

In operation, with toy 10 initially configured as shown in FIG. 2, the user squeezes torso 27 forcing panel 36 to pivot inwardly about shaft 46 in the direction indicated by arrow 80. The inward pivotal movement of panel 36 in turn rotates wheel 45 and gear segment 50 in the direction indicated by arrow 82. The engagement between gear 45 and gear segment 50 causes gear 43 and arm to pivot in the direction indicated by arrow 83. As panel 36 continues to move inwardly, arm 21 is pivoted upwardly to the dashed-line position shown in the direction indicated by arrow 84.

As the user squeezes panel 36 inwardly, the movement of panel 36 is opposed by spring 68 as end 38 of post 37 forces plate 64 in the direction indicated by arrow 81. The inward movement of plate 64 causes flexing of flexible reed 61 producing the above-described clicker sound.

When the user releases torso 27 (seen in FIG. 1) and panel 36, the force of spring 68 drives plate 64 upwardly in the direction indicated by arrow 90 which in turn forces post 37 outwardly thereby pivoting panel 36 about shaft 46 in the direction indicated by arrow 91. The return motion of panel 36 in the direction indicated by arrow 91 rotates wheel 45 and gear segment 50 in the direction indicated by arrow 92. The engagement of gear 43 and gear segment 50 causes gear 43, arm shaft 42 and arm 21 to pivot in the direction indicated by arrow 93. Correspondingly, as arm 21 pivots downwardly, hand 23 and whip handle 24 are pivoted in the direction indicated by arrow 94.

Thus, the mechanism utilized within housing 40 responds to squeezing pressure upon the doll torso which drives panel 36 inwardly raising arm 21 and the force of spring 68 upon release of the doll torso and panel 36 to rapidly pivot arm 21 downwardly again. The successive upward and downward pivotal movements of arm 21 when properly timed by squeezing and releasing of the doll torso manipulates whip 19 through a simulated whip-cracking motion. During this game play, the succession of clicking sounds produced by flexible reed 61, which clicks each time arm 21 is raised and clicks again each time arm 21 is lowered, produce a sound similar to a cracking whip sound.

What has been shown is a hand held doll which provides a whip-cracking motion in response to a simple squeeze and release action applied to the doll torso. The mechanism is entirely mechanical and thus does not require any battery power or motor drive. The clicking sound is achieved by the simple addition of a flexible metal reed within the support mechanism of the cam follower plate. The entire device is simple in construction and is manufacturable of mass produceable parts such as molded plastic materials or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A hand held doll comprising:

a body having a head, supporting legs and a torso;

an arm pivotally supported at said torso and having a hand;

a gear joined to said arm pivotal therewith;

a simulated whip having a handle held by said hand, a flexible cord and an end weight;

a housing supported within said body supporting said arm and said gear and having a panel pivotally supported by said housing and a gear segment engaging said gear; and a return spring coupled to said panel urging said panel outwardly;

said panel pivoting inwardly when said doll is squeezed and pivoting outwardly by said spring when said squeeze is released thereby pivoting said gear segment and said gear to pivot said arm in a whip cracking movement.

2. The hand held doll set forth in claim 1 further including sound means actuated by movement of said panel.

3. The hand held doll set forth in claim 2 wherein said sound means includes:

a flexible resilient reed having one end fixed to said housing and a second end; and a plate secured to said second end and interposed between said return spring and said panel;

said reed producing a click sound when flexed as said panel moves.

4. The hand held doll set forth in claim 3 wherein said panel includes a post extending to said plate.

* * * * *